United States Patent [19]

Isler

[11] Patent Number: 4,523,880

[45] Date of Patent: Jun. 18, 1985

[54] TIE ROD ASSEMBLY FOR ROCK BOREHOLE ANCHOR

[75] Inventor: Erwin Isler, Rapperswil, Switzerland

[73] Assignee: H. Weidmann, AG, Rapperswil, Switzerland

[21] Appl. No.: 491,489

[22] Filed: May 4, 1983

[30] Foreign Application Priority Data

May 14, 1982 [CH] Switzerland ..... 3023/82
Dec. 29, 1982 [CH] Switzerland ..... 7614/82

[51] Int. Cl.[3] ..... E21D 21/00; F16B 2/14; F16B 43/00

[52] U.S. Cl. ..... 405/259; 411/33; 411/537

[58] Field of Search ..... 405/259–262; 52/698, 704; 411/32, 33, 383, 424, 537, 538

[56] References Cited

U.S. PATENT DOCUMENTS

| | | | |
|---|---|---|---|
| 2,879,686 | 3/1959 | Lewis | 405/259 X |
| 3,469,407 | 9/1969 | Kovacs | 405/259 X |
| 3,837,258 | 9/1974 | Williams | 405/260 X |
| 4,011,787 | 3/1977 | White et al. | 405/259 X |
| 4,112,693 | 9/1978 | Collin et al. | 405/259 X |
| 4,347,020 | 8/1982 | White et al. | 405/260 |
| 4,362,449 | 12/1982 | Hlinsky | 411/537 X |

FOREIGN PATENT DOCUMENTS

| | | | |
|---|---|---|---|
| 645314 | 7/1962 | Canada | 405/259 |
| 2304813 | 10/1976 | France | 411/33 |
| 70419 | 10/1930 | Sweden | 411/383 |
| 583345 | 12/1976 | Switzerland | 52/698 |
| 396093 | 7/1933 | United Kingdom | 411/424 |

OTHER PUBLICATIONS

"New Parts and Materials—Self Aligning Lock Nut" Machine Design, Jan. 19, 1961, vol. 33, No. 2.

*Primary Examiner*—Cornelius J. Husar
*Assistant Examiner*—Nancy J. Stodola
*Attorney, Agent, or Firm*—Sughrue, Mion, Zinn, Macpeak, and Seas

[57] ABSTRACT

A tie rod assembly for a rock borehole anchor includes a tension rod 3 having a plurality of wedge shaped spreading bolts 10 at its lower end surrounded by spreading sleeve 20 segments 21, and a sleeve 40 on its upper end threaded to a tension nut 60 which bears against a ground support or anchor plate 70 upon installation and tightening. The sleeve 40 mates with the tension rod via saw tooth configured circumferential ridges or fins 45, 46 having increasing inclination angles, to thereby provide for a constant force transmission per unit of tooth length. The tension nut and anchor plate have complementarily configured spherical bearing surfaces 65, 77, and the ground engaging lower area of the anchor plate has fracturable webs 75 to accommodate surface irregularities and projections.

14 Claims, 16 Drawing Figures

TIE ROD ASSEMBLY FOR ROCK BOREHOLE ANCHOR

BACKGROUND OF THE INVENTION

This invention concerns a tie rod for a rock securing system.

When building cavities into rock or when removing rock walls, forces are generated which tend to move the rock towards the free space. To prevent this rock anchoring units are installed at the ends of the boreholes and are tightened at the beginnings of the boreholes or at the free rock wall by an anchor plate and a draw bolt.

A problem arises with the anchoring at the end of the borehole, and several suggestions have already become known in this context. According to German Pat. No. 1,117,071, a rigid crescent-shaped wedge is placed against the tension element or the anchor bolt which is held in the axial direction by its shape and friction. The outer surface of the wedge is inclined towards the axis of the tension element and interacts with the inner jacket surface of a loose wedge, also having a crescent-shaped cross-section, such that with a tension force the rigid wedge is shifted vis-a-vis the loose wedge and thus pushes it against the rock. The two wedges are connected with each other by an elastic element so that they can be inserted together into the borehole. The disadvantage is that, in addition to the functional tension forces, bending forces also act on the tension element by means of which the possible tension load is reduced.

According to another suggestion in Swiss Pat. No. 564,654, the anchoring element is designed as a shapeable body which rests in the borehole in its reshaped state. The anchoring element is designed as a hollow body and the tension element is fastened in a closing plate underneath the hollow body. A viscous substance is pushed into the hollow body through the tension element which is designed as a tube so that its shape conforms exactly to the borehole. With such a tie rod, the friction of the hollow body is limited by both the tension element and the borehole. The hollow body consists of a shapeable sleeve, and an additional force limitation is thus given by the rigidity of this sleeve and the tension element cannot be utilized up to its own load capability.

In the rock anchoring unit according to German Pat. No. 2,903,694 a spreading sleeve held in the borehole in a clawlike manner is placed on the tension element and can be tightened through a spreading bolt by turning the tension nut. For this purpose, the ends of the tension elements are conically expanded in order to receive a spreading wedge. When the spreading bolt is designed with a star-shaped cross-section and the points engage in the gap in the tension element effecting the conic expansion, the material, particularly the glass fibers in a synthetic resin tube, cannot turn aside and the strength is increased. However, it has been determined that such a glass fiber synthetic resin tube (GFK) is not held to a sufficient extent by the radial pressure between the spreading bolt and the spreading sleeve, and can therefore slide out. Even when pouring additional epoxy resin, no essential improvement is obtained.

A further problem is created by the threaded portion of the tension rod exerting a tension force by means of a tightening nut.

SUMMARY OF THE INVENTION

It is therefore the task of the invention to create a tie rod with which, independently of the material used for the tension element, a high tension force can be exerted and which is simple in its production and consists of few parts.

According to the invention, this is achieved by a tie rod assembly for a rock borehole anchor having a tension rod mounting a plurality of wedge shaped spreading bolts at its lower end surrounded by spreading sleeve segments, and a sleeve on its upper end threaded to a tension nut which bears against a ground support or anchor plate upon installation and tightening. The upper sleeve mates with the tension rod via saw tooth configured circumferential ridges or fins having increasing inclination angles, to thereby provide for a constant force transmission per unit of tooth length. The tension nut and anchor plate have complementarily configured spherical bearing surfaces, and the ground engaging lower area of the anchor plate has fracturable webs to accommodate surface irregularities and projections.

DETAILED DESCRIPTION OF THE PREFERRED EMBODIMENTS

Figure 1:
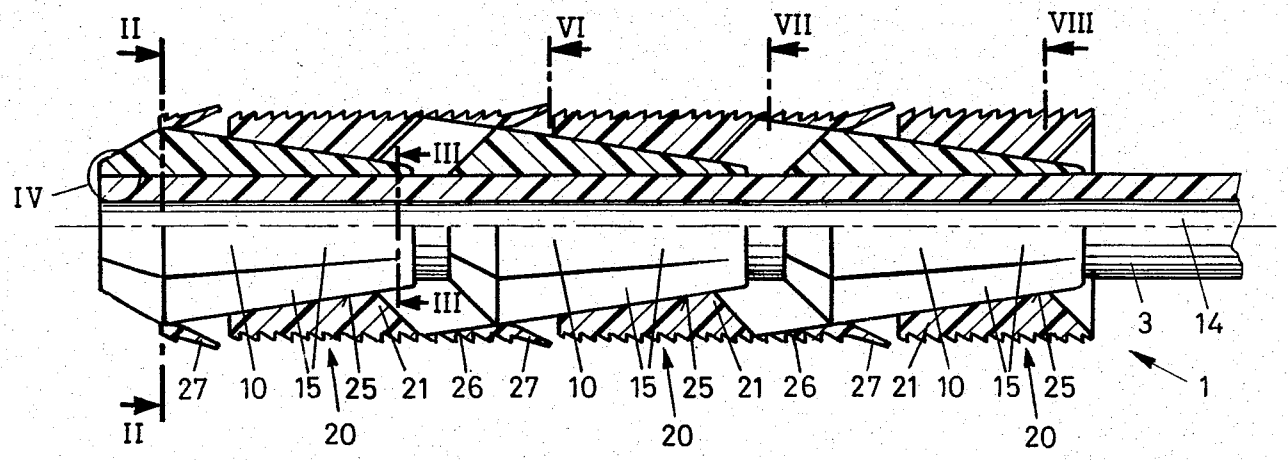
FIG. 1 is a vertical projection of an anchoring element divided down the center line with a sectional view of the spreading sleeve and a top view of the spreading bolt fastened on the tension element as illustrated below the center line, and with a sectional view through the spreading bolt and spreading sleeve illustrated above the center line.
Figure 5:
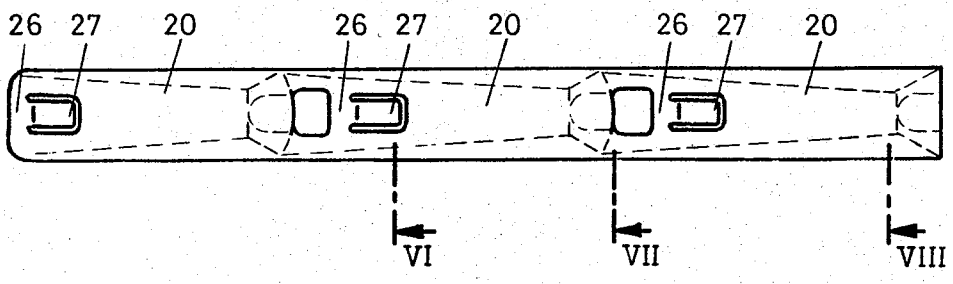
FIG. 5 is a top view of the spreading sleeve.
Figure 3:
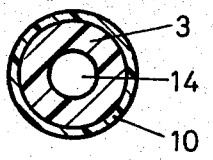
FIG. 3 is a sectional view of the spreading bolt fastened on the tension element according to line III—III in FIG. 1.
Figure 2:
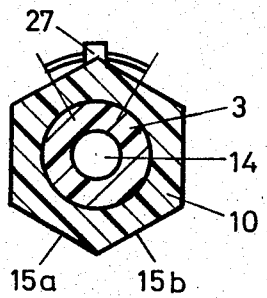
FIG. 2 is a sectional view of one of six spreading sleeves surrounding the spreading bolt which is fastened on the tension element according to line II—II in FIG. 1.
Figure 6:
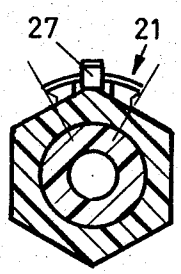
FIG. 6 is a sectional view one of six spreading sleeves surrounding the spreading bolt which is fastened on the tension element according to line VI—VI in FIG. 1 (5)
Figure 10:
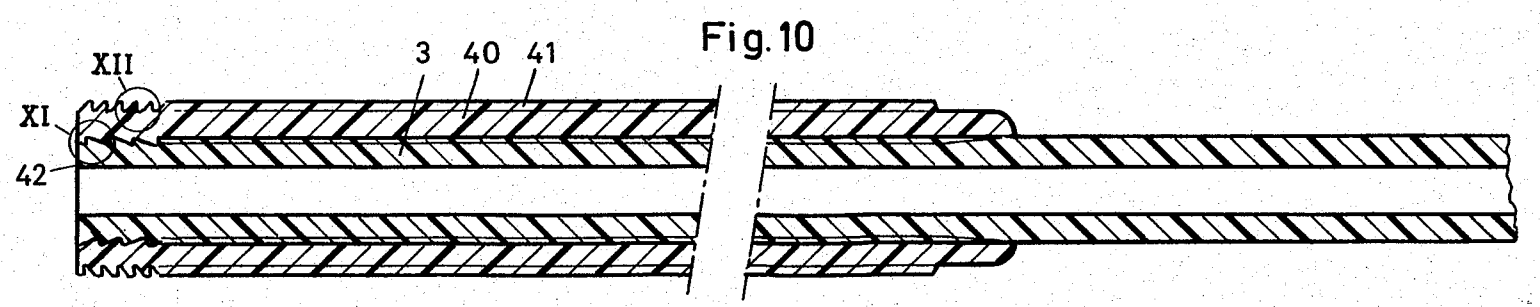
FIG. 10 is a sectional view of an axially cut anchoring element illustrating the junction between the tension element and the threaded sleeve and outer thread which use the principle explained with FIG. 9.

According to FIG. 1, the anchoring element 1 consists of a number of spreading bolts 10 which are fastened on a tension element 3, and a like number of spreading sleeves 20. The bolts 10 have wedge surfaces 15 which form an angle with the axis of the tension element 3. In the example shown, this angle is 9°. In the area of the largest diameter of the bolts 10, the sectional view according to FIG. 2 shows the outline formed by the wedge abutment surfaces. At the smallest circumference of the bolts 10 as shown in FIG. 3, the bolts envelope the tension element 3 in a practically circular manner.

Figure 4:
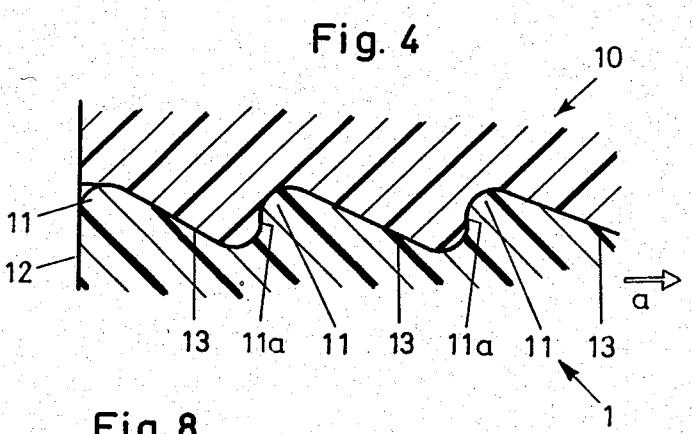
FIG. 4 is a sectional line of the segment IV in FIG. 1 illustrating the junction between the spreading bolt and the tension element in a highly enlarged scale.

To achieve a pressure-locked connection between the bolts 10 and the tension element 3, the surface of the tension element is provided with saw-tooth-shaped circumferential ridges or fins 11 according to FIG. 4. The steep flanks 11*a* of these fins are directed towards the end 12 of the tension element and the flat flanks 13 are opposite it. Therefore, a tension force in the direction of the arrow a acting on the tension element is transmitted to the spreading bolts 10 across the flat flanks 13. In this way, the transmission and reduction of the force is effected on a step-by-step basis in the tension element, and the bolts 10 receive a force which is increased in a step-by-step manner. Since the spreading bolts also have an increasing circumference in the direction towards the end 12 of the tension element 3, these forces can be absorbed without excessive stress on the material.

The tension element 3 advantageously comprises a glass fiber synthetic resin tube with an axial borehole 14, and the spreading bolts 10 may be made of thermoplastics and directly attached to the tension element, as by molding thereto or by heat softening and force fitting.

Corresponding to the hexagonal wedge surfaces 15, the spreading sleeves 20 each consist of six segments 21 which surround a bolt. As seen in FIG. 1, the segments 21 are wedge shaped and rest on a wedge surface 15 of a spreading bolt 10. There is thus always an areal contact with the relative axial shifting of spreading bolts 10 and segments 21 of the sleeve 20. In this way of tension force is evenly distributed, and the pressure does not exceed an admissible degree at any point.

Circumferentially, the segments 21 are connected with each other, for example by hook-shaped tongues and grooves to permit a relative lateral freedom of movement so that the spreading sleeves 20 can be expanded by axial shifting on the bolts 10.

Figure 8:
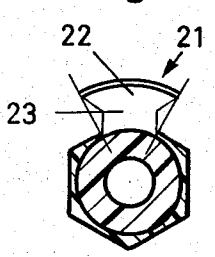
FIG. 8 is a sectional view of one of six spreading sleeves surrounding the spreading bolt which is fastened on the tension element according to line VIII—VIII in FIG. 1 (5)

As is shown in FIG. 8, the segments 21 have a T-shaped design with a crossbar 22 which is tapered with an increasing distance from the carrying web 23. In this fashion the pressure is exerted axially of the segments on the rock and is lower towards the outside. The rock is thus bulged axially more strongly and the force can be exerted uniformly on it to avoid breaks next to the segments.

Figure 7:
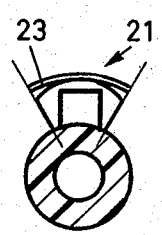
FIG. 7 is a sectional view spreading sleeve and the tension element according to line VII—VII in FIG. 1 (5)

The cross-section according to FIG. 7 lies at a point between two segments 21, and shows the longitudinal connection formed between adjacent segments by a peel-like bridge portion 26. The portions 26 between two spreading sleeves 20 following each other are designed with tongues 27 projecting outwardly, which keep the sleeves in contact with the rock.

By providing three or more spreading bolts 10, the transmission of force is effected uniformly along a greater length than would be the case with only one wedge of the known designs. The hexagonal wedge surfaces 15*a*, 15*b*, distributed around the circumference of the bolts permit the segments 21 to always rest with a constant area on the bolts so that there is always the same area pressure. Larger bore diameter differences can be accommodated by the extension of the length of the force transmission by providing a plurality of spreading bolts 10; for example, a borehole may now vary between 34 and 40 mm instead of the 34 and 36 mm with the prior art.

The outer surfaces of the segments may be finned as shown, or roughened in any other way to effect a better adherence to the rock.

Tests have shown that an anchoring element 1 as described can withstand forces in the order of magnitude of the tensile strength of the tension element 3. With the use of a tube as the tension element, epoxy resin or mortar can be injected which can also spread outside the tension element without additional injection tubes owing to the shape of the segments with the tapered carrying webs 23.

Instead of hexagonal wedge surfaces 15 as described, cylindrical surfaces can also be provided. The sectional outline of FIG. 2 would then look cycloidal. Advantageously, the cylindrical surfaces should have the same curvature as the tension element 3.

Figure 9:
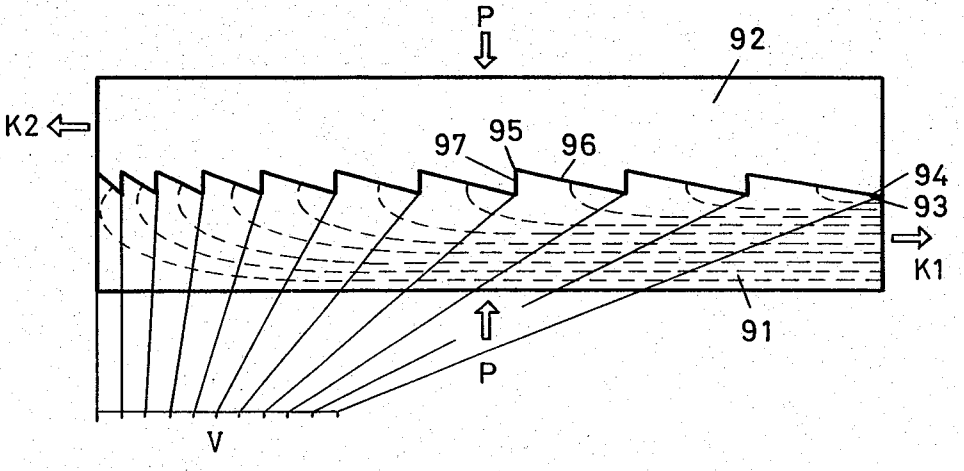
FIG. 9 is a schematized sectional view through the tension element and tension nut showing the force transitions.

In FIG. 9, two elements 91 and 92 are placed on top of each other with their sectionally visible surfaces 93 and 94 pressed together vertically in accordance with the arrows P. If a tension force K1 is exerted on the first element 91 towards the right in the drawing and/or a tension force K2 is exerted on the second element 92 towards the left, this results in a force transition arrangement similar to that shown in FIG. 4 between the tension element and the sleeve.

The idea on which the different length flanks 96 are based with a constant ridge height 95 is to maintain constant the transmission of the force per unit of tooth length. For this reason, the expansion of the material was introduced with an increasing force from left to right and the lengths of the flanks 96 were expanded, in comparison with the assumed original and non-loaded length of a comparison rod V, in accordance with a tension force of one unit on the very left on a step-by-step basis up to ten units on the right. Owing to the constant areal pressure on the flanks 96, the force K1 is uniformly reduced with each step and the second element 92, on the right in the drawing, on which no force is exerted pulls on the fictive fastening on the left with the total force K1 so that, inversely, the force K2 is actually the force K1 at this fastening. The development of the force is represented in the first element 91 by dotted lines.

The principle illustrated in FIG. 9 is applied to the tension element embodiment shown in FIGS. 10–15. This tension element 3, for example of fiber-reinforced plastic material, is provided with toothing at its end as is the first element 91 in FIG. 9. The long flanks 96 and the short flanks 97 are circumferential surfaces. The tension element prepared in this manner is provided in a die mold with a threaded sleeve 40, which has a tooth shape complementary to that of the tension element and a section according to the second element 92 in FIG. 9. A thread 41 is formed on the outer circumference of the sleeve 40.

Figure 11:
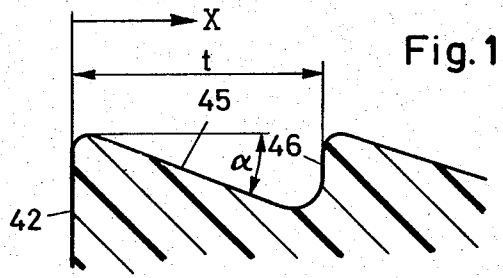
FIG. 11 is a segmental enlargement illustrating a toothed portion of the tension element at point XI in FIG. 10.

The toothed portion is clearly shown in FIG. 11. The inclined angle $\alpha$ of the longer flank 45 (corresponding to flank 96 in FIG. 9) is a function of the distance X from the end 42 of the tension element, and the axial length t of a flank results from this angle $\alpha$ between two adjacent steep flanks 46.

Figure 12:
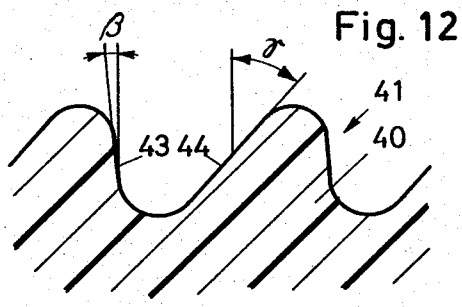
FIG. 12 is a segmental enlargement illustrating the outer thread of the threaded sleeve at point XII in FIG. 10.

The shape of the outer thread 41 which is a buttress thread is shown in FIG. 12. The inclined angle $\beta$ of the steep tooth flank 43 is 5° and that of the flat tooth flank 44 is $\gamma=40°$, with a distance between the steep flanks 43 of 3.5 mm and a tooth height of 1.84 mm. With this combination of toothing between the tension element 3 and the threaded sleeve 40, and a buttress thread which is designed for high forces from the same direction, the tension force is transferred from the element 3 to a tension nut 60 on the threaded sleeve 40 in sections, whereby use is made of the entire length of the tension nut 60.

Figure 13:
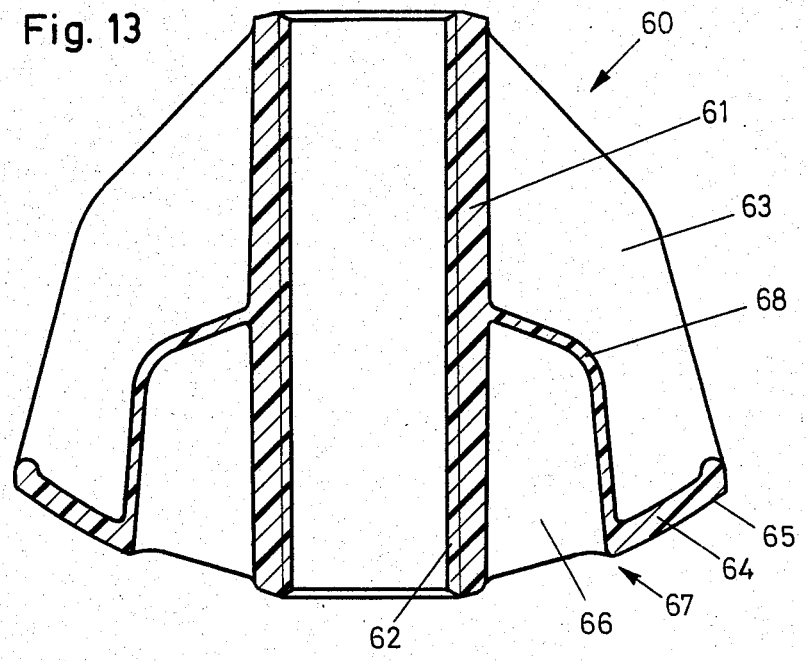
FIG. 13 is a sectional view of a tension nut for use with the tension rod according to FIG. 10.
Figure 14:
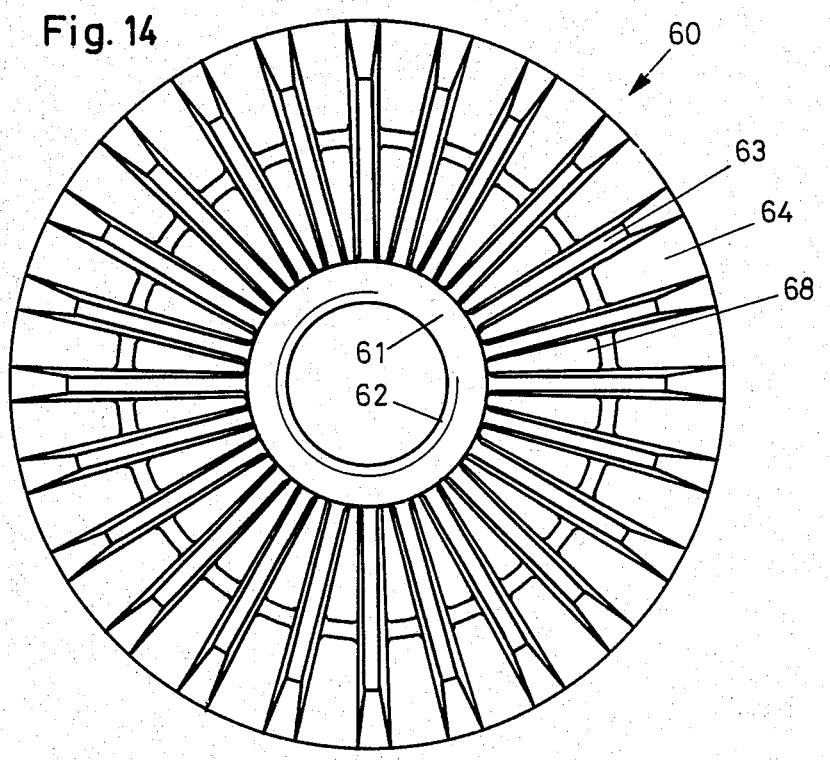
FIG. 14 is a front view of the tension nut according to FIG. 13.

The tension nut is shown in FIGS. 13 and 14, and has a central sleeve 61 with an inside thread 62. There are several fins 63, 66 distributed around the circumference of the sleeve 61. At the lower end 67, the sleeve is provided with an annular supporting flange 64 which has a spherically shaped outer surface 65. The flange is joined to the sleeve by a support web or hood 68. There are twenty four fins 63, 66 spaced apart 15°.

Figure 15:
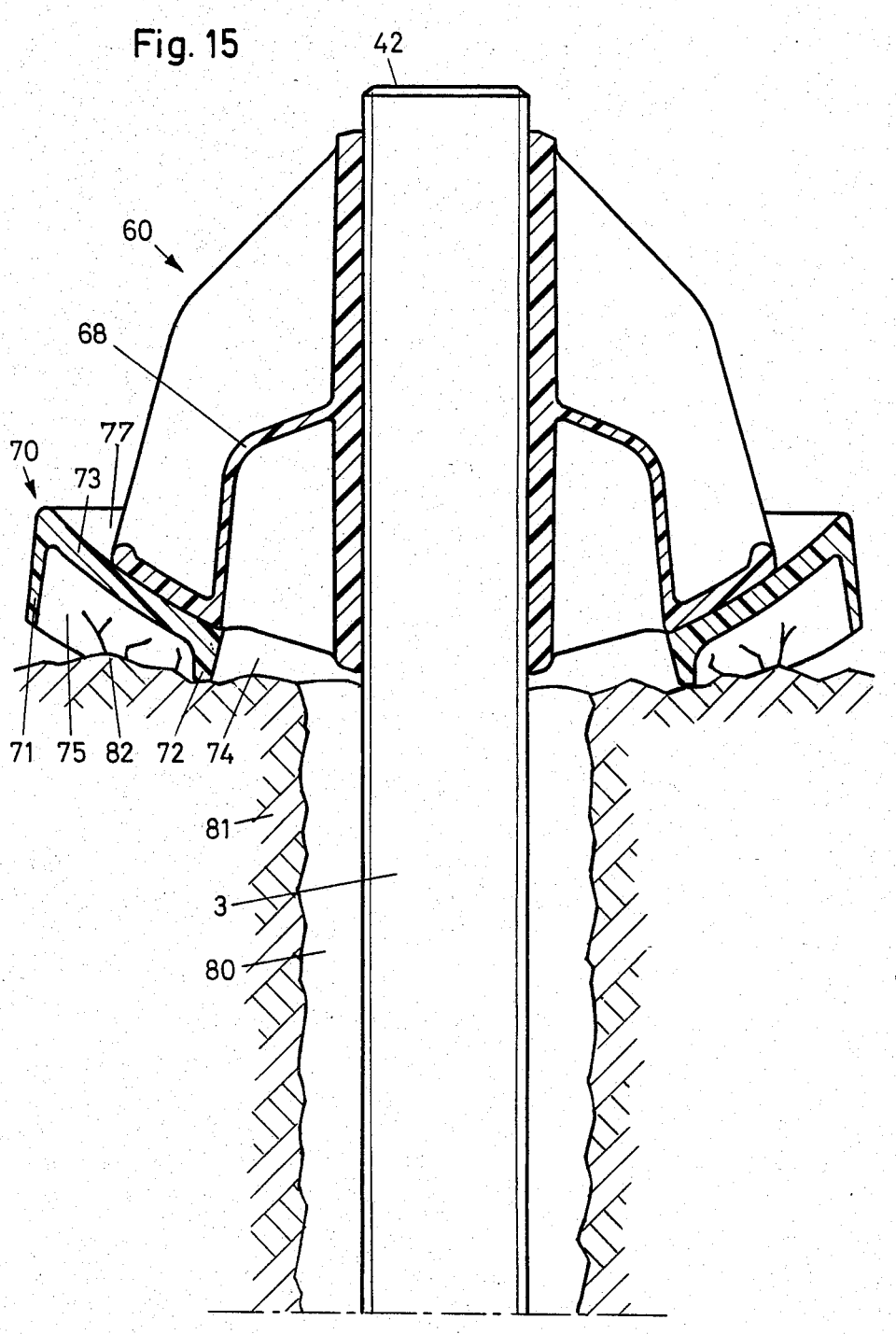
FIG. 15 is a sectional view through the free end of the tension anchor with the tension nut and anchor plate placed on a rock.

The installation of a tension element in a borehole 80 in a rock 81 is shown in FIG. 15. An annuar anchor plate 70 with a central hole 74 is placed over the borehole. The load bearing surface 77 on which the outer surface 65 of the tension nut 60 rests is concave and spherically shaped with the same radius as the surface 65. Fins 71, 72 are concentrically disposed around the outside and inside of the bearing surface. The area between the fins is provided with segment plates 75 arranged radially in axially parallel planes or intersecting each other in a honeycomb-like manner. An arrangement of cylindrical planes and radial planes is also possible. The plates form a crumpling zone and can be pressed together by projecting points 82 on the surface of the rock 81. In this way the anchor plate 70 rests uniformly on the rock.

The surface defined by the free front sides of the plates can also be arched, whereby the edges of the fins 71, 72 are still connected with each other.

FIG.15 also shows the function of the hook 68 of the tension nut in covering the central hole 74 in the anchor plate.

With the disclosed arrangement the lines of force 91 are led in discrete bundles across the long flanks 45 of the teeth to the threaded sleeve 40, and substantially uniformly transferred across the buttress threads 41 to the tension nut 60 where they are concentrated on the outer surface 65 and further transferred to the anchor plate 70.

Tests have shown that, with this design, a tension element in the form of a glass fiber reinforced plastic tube in which the glass fibers run parallel and longitudinally, can be utilized up to its own breaking load without the anchoring element coming loose in the borehole or the attached threaded sleeve 40 being pushed off the tension element.

Figure 16:
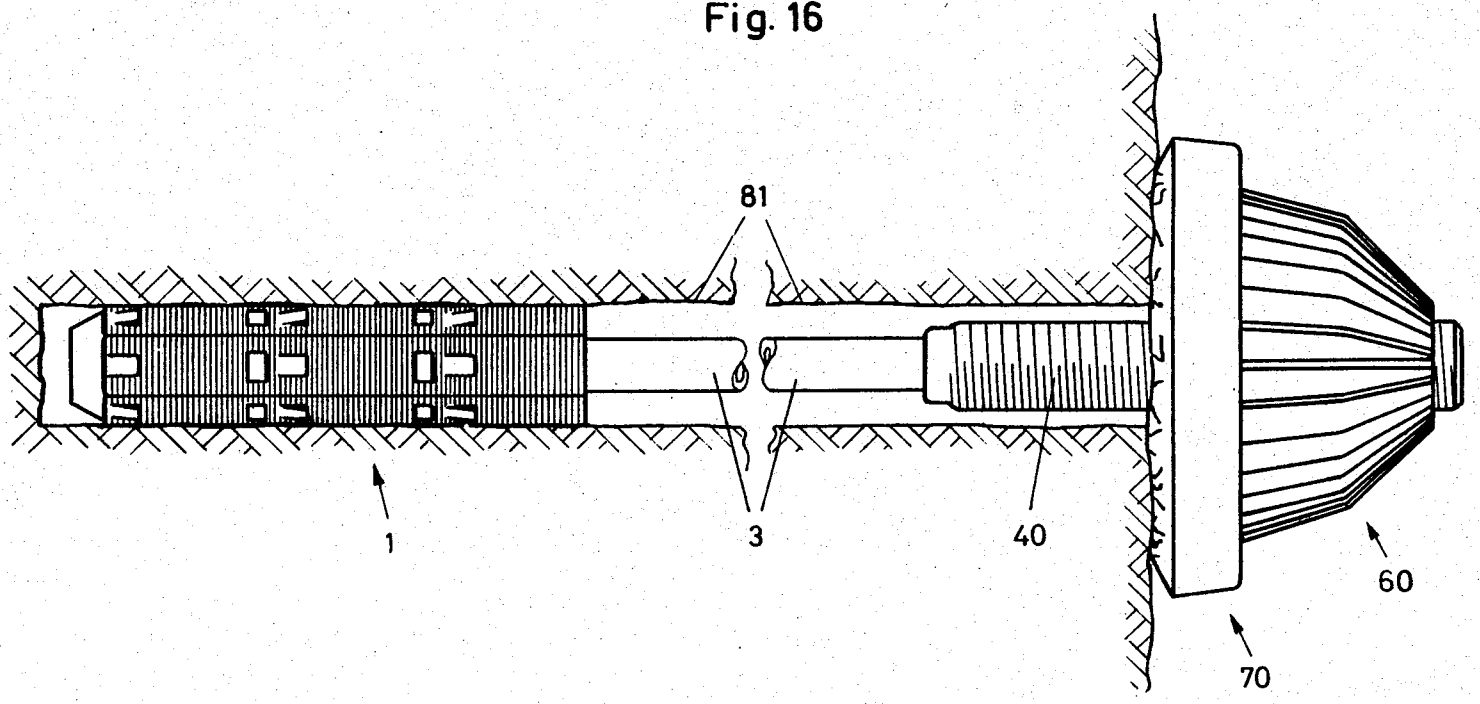
FIG. 16 is a top view of entire tie rod assembly comprising the tension element, spreading bolts (not shown), the threaded sleeve, the spreading sleeves, an anchor plate and a tension nut.

FIG. 16 shows the entire tie rod assembly. The anchoring element 1 is fastened on the tension element 3. The threaded sleeve 40 forms one end of the tension element 3 so that when the anchor plate 70 is placed on the sleeve 40 and the tension nut 60 is tightened, the tension element 3 will be drawn out through the tension nut.

What is claimed is:

1. A tie rod for a rock securing system having a tension element anchored in a borehole by a molded anchoring element which rests against the wall of the borehole and holds the tension element, the tension element being connected with the anchoring element in a pressure-locked mannner in the rock by frictional force, and the free end of the tension element being threaded to a tension nut supported by an anchor plate resting against the surface of the rock, characterized by: the anchoring element (1) comprising a plurality of axially spaced spreading bolts (10) each solidly connected with the tension element (3) and each having a plurality of wedge surfaces (15) surrounding the tension element, and a plurality of spreading sleeves (29) individually associated with and surrounding the bolts and connected with each other, a threaded sleeve (40) coupled to a free end (42) of the tension element, the outer surface of the tension element and the inner surface of the threaded sleeve each having a plurality of mating elevations (95, 96, 97), said elevations having a sawtooth sectional configuration with equal height flanks (45) of increasing length from the free end, and the tension nut (60) and anchor plate (70) each having an arched surface of the same shape (65, 77) in the area where the tension nut bears against the anchor plate.

2. Tie rod according to claim 1, wherein the bolts and the tension element are connected with each other in a pressure-locked manner by radial fins **(11, 11*a*)** engaging with each other.

3. Tie rod according to claim 2, wherein the fins have a saw tooth shape with inclined flanks (13) inclined in a direction opposite the free end.

4. Tie rod according to claim 1, wherein each bolt has a double truncated cone sectional shape.

5. Tie rod according to claim 1, wherein each spreading sleeve (20) comprises a plurality of connected segments (21) having inside surfaces mating with and complementary to the wedge surfaces (15) and roughened outside surfaces, each segment having a T-shaped section from which a crossbar (22) becomes increasingly thicker from an outer edge towards a rhombic carrying web (23).

6. Tie rod according to claim 5, wherein axial connecting portions (26) are provided between adjacent spreading sleeves, and each sleeve has outwardly projecting centering tongues (27).

7. Tie rod according to claim 1, wherein the tension nut (60) comprises a cylindrical sleeve (61) provided with radial fins (63, 66) and a support flange (64) at its lower end (67) whose outer surface (65) is convex, and wherein the thread (62) of the tension nut and the corresponding thread (41) of the threaded sleeve are buttress threads.

8. Tie rod according to claim 7, wherein the support flange is annular and is joined to a hook (68) surrounding the cylindrical sleeve.

9. Tie rod according to claim 1, wherein the anchor plate (70) is annular and has surrounding outer and inner fins (71, 72) bridged by segment plates (75).

10. Tie rod according to claim 9, wherein the segment plates are radially arranged.

11. Tie rod according to claim 10, wherein a bearing surface (77) of the anchor plate for the outer surface (65) of the tension nut support flange (64) is concave.

12. Tie rod according to claim 11, wherein the shapes of the bearing surface and the outer surface are spherical.

13. A tie rod for a rock securing system having a tension element anchored in a borehole by a molded anchoring element which rests against the wall of the borehole and holds the tension element, the tension element being connected with the anchoring element in a pressure-locked manner in the rock by frictional force, and the free end of the tension element being threaded to a tension nut supported by an anchor plate resting against the surface of the rock, characterized by: the anchoring element (1) comprising a plurality of axially spaced spreading bolts (10) each solidly connected with the tension element (3) and each having a plurality of wedge surfaces (15) surrounding the tension element, and a plurality of spreading sleeves (20) individually associated with and surrounding the bolts and connected with each other.

14. Tie rod according to claim 13, wherein the plurality of wedge surfaces (15) surrounding the tension element further comprise cylindrical surfaces.

* * * * *